US005424161A

United States Patent [19]

Hayashi et al.

[11] Patent Number: 5,424,161

[45] Date of Patent: Jun. 13, 1995

[54] TONER COMPOSITION

[75] Inventors: Norihiro Hayashi; Hiroyoshi Hiramatsu; Kuniyasu Kawabe, all of Wakayama, Japan

[73] Assignee: Kao Corporation, Tokyo, Japan

[21] Appl. No.: 117,740

[22] Filed: Sep. 8, 1993

Related U.S. Application Data

[63] Continuation of Ser. No. 708,715, May 31, 1991, abandoned.

[30] Foreign Application Priority Data

Jun. 7, 1990 [JP] Japan ..... 2-150389

[51] Int. Cl.[6] ..... G03G 9/00

[52] U.S. Cl. ..... 430/110; 430/109; 430/108

[58] Field of Search ..... 430/110, 109, 108

[56] References Cited

U.S. PATENT DOCUMENTS

| | | | |
|---|---|---|---|
| 4,725,521 | 2/1988 | Shigeta et al. | 430/108 |
| 4,804,622 | 2/1989 | Tanaka et al. | 430/109 |
| 4,939,059 | 6/1990 | Kawabe et al. | 430/109 |
| 4,946,755 | 8/1990 | Inoue | 430/110 |
| 5,073,468 | 12/1991 | Yamamoto et al. | 430/110 |

FOREIGN PATENT DOCUMENTS

| | | |
|---|---|---|
| 0270063 | 3/1988 | European Pat. Off. . |
| 0259642 | 8/1988 | European Pat. Off. . |
| 0333498 | 3/1989 | European Pat. Off. . |
| 58-11954 | 1/1983 | Japan . |
| 59-29257 | 2/1984 | Japan . |
| 59-81650 | 5/1984 | Japan . |
| 59-123854 | 7/1984 | Japan . |
| 59-231552 | 12/1984 | Japan . |
| 61-188546 | 8/1986 | Japan . |
| 62-195678 | 2/1987 | Japan . |

*Primary Examiner*—Mark A. Chapman

*Attorney, Agent, or Firm*—Birch, Stewart, Kolasch & Birch

[57] ABSTRACT

The present invention is directed to a toner composition containing a polyester resin having an OHV/AV value of 1.2 or more as a major component of a binder resin wherein AV is an acid value of said polyester and OHV is a hydroxyl value thereof and hydrophobic silica having a degree of hydrophobic property of 80 or more or having a pH value of 5.5 to 8 in water-methanol solution. A toner composition of the present invention exhibits no decrease in electric charge retainability and fluidity of a toner and a visible image with good quality for a long period with no black spots occurring.

13 Claims, No Drawings

TONER COMPOSITION

This application is a continuation of application Ser. No. 07/708,715 filed on May 31, 1991, now abandoned.

BACKGROUND OF THE INVENTION

1. Field of the Invention

The present invention relates to a toner composition for development of an electrostatic image in the electrophotographic process, electrostatic recording process, electrostatic printing process and the like.

2. Description of the Prior Art

In development of the electrostatic image in electrophotography, a toner must have high fluidity in order to form a visible image with good quality. For this purpose, fine powder of silicon dioxide (silica) has been generally used in admixture with toner powder as a surface flow auxiliary.

However, because fine powder of silica is hydrophilic when it is directly used, it absorbs moisture in the air under high temperature and high humidity conditions, which decreases the fluidity or causes aggregation of toner particles. For this reason, it has been proposed to use silica fine powder treated by a hydrophobic treatment (See the Japanese Patent Laid-Open Nos. 5782/1971 and 47345/1973). For example, a dimethyl substitution product has been known, in which a methyl group of silane is bonded with silica by a reaction of dimethyldichlorosilane with hydrophilic silica (R-972: Nippon Aerosil Co., Ltd.).

However, the fine powder of silica is not hydrophobic enough even if it has been treated to have a hydrophobic property. Aggregation property is noted at high temperature and high humidity and the fluidity of the toner is decreased. Thus, the degree of hydrophobic property has become an important issue.

Specifically, in case of R-972, for example, the silanol group of hydrophilic silica is turned to hydrophobic only by 70 to 80% while the remaining 20 to 30% of silanol groups are not substituted and remain unchanged. The degree of hydrophobic property of R-972 is thus only 40.

Therefore, it has been pointed out that, when silica fine powder with such a degree of hydrophic property is used, it is difficult to stably form a great number of visible images with good quality for a long period by the toner.

More recently, there have been several proposals to solve these problems. For instance, the stable formation of a visible image with good quality in forming a great number of visible images for a long period can be obtained when hydrophobic silica fine powder having a hydrophobic index (i.e. a degree of hydrophobic property) of 50 or more, or more preferably 65 or more, which is obtained through a hydrophobic treatment of organic silicon compounds having a specific organic group, is added and mixed with toner powder in an amount of 0.01 to 15% by weight (Japanese Patent Laid-Open No. 81650/1984). There is also the proposal to contain 0.01 to 20% by weight of hydrophobic silica fine powder obtained through a hydrophobic treatment so that the degree of hydrophobic property is within the range of 30 to 80 (Japanese Patent Laid-Open No. 231552/1984).

Such a hydrophobic treatment has been used in the method already known, in which a chemical treatment is performed by an organic silicon compound reacting or physically adsorbing with silica fine powder. In general, a method is adopted, by which a treatment is performed by an organic silicon compound during or after the time the silica fine powder obtained by a vapor phase oxidation of a silicon halogen compound has been treated by a silane coupling agent.

However, hydrophobic silica with high hydrophobic property known in the past has a hydrophobic degree of below 80 at most. Indeed those hydrophobic silicas described in the above patent publication (Japanese Patent Laid-Open No. 231552/1984) have only a hydrophobic degree of up to 74.

The Japanese Patent Laid-Open No. 81650/1984 describes the compound with a degree of hydrophobic property of more than 65 as a high hydrophobic compound, whereas the upper limit is not clear, and it is also not known how high the hydrophobic property of the compound disclosed in the above patent publication is obtained. The hydrophobic silica having the hydrophobic degree of below 80 at most shows the improvements in electric charge retainability and fluidity compared with the conventional dimethyl substitution product having the hydrophobic degree of 40 to 42. This was not sufficient for the purpose, however, under high temperature and high humidity conditions because electric charge retainability and fluidity decreased or the stable formation of a visible image with good quality was hindered.

In case that the degree of hydrophobic property is not enough, a number of unreacted silanol groups remain in the hydrophobic silica, or in case that the substitutents reacted with silanol groups are small groups of atoms as a whole, a stable hydrogen bond is formed by carboxyl group in the binder resin of toner particles and moisture in the surroundings with the other unreacted silanol groups. As the result, the above problems arise under high temperature and high humidity conditions.

Therefore, whether the degree of hydrophobic property is enough or not is determined by which kind of hydrophilic groups the binder resin has.

As the binder resin for a toner, various types of resins are used including styrene type copolymers such as polystyrene, styrene-butadiene copolymer, styrene-acrylic copolymer, etc., ethylene type copolymers such as polyethylene, ethylene-vinyl acetate copolymer, etc., poly-(meth)acrylic acid ester, polyester resin, epoxy resin, and polyamide resin, etc. Of these resins, those having a naturally high hydrophobic property such as normal styrene-acrylic resin, a high degree of hydrophobic property is normally not required of the silica. Above all, however, a polyester resin is obtained by condensation polymerization of alcohol and carboxylic acid. Because many carboxyl groups, which are hydrophilic groups, are contained in this resin, hydrogen bonds of such groups with water cause the decrease of electric charge retainability and fluidity of the toner. Thus, it has been pointed out that the degree of hydrophobic property is not sufficient.

When a polyester resin is used as a major component of a binder resin, a polyester resin having an OHV/AV of 1.2 or more is commonly used wherein AV is an acid value of a polyester resin and OHV is a hydroxyl value thereof. The reason for this is as follows: the lowest fixing temperature of the toner obtained from a polyester resin having the OHV/AV value of below 1.2 is higher than that of the toner obtained from a polyester resin having the value of 1.2 or more. Further, it has lower fluidity, and it is necessary to add a large quantity of a surface flow auxiliaries such as hydrophobic silica fine powder to obtain sufficient fluidity.

Also, in the coventional type hydrophobic silica, it is necessary to add more quantity of hydrophobic silica to maintain the fluidity of toner particles. For example, in the above patent publication (Japanese Patent Laid-Open No. 81650/1984), which describes the compound with a hydrophobic index of 50 or more, it is proposed to add hydrophobic Silica in an amount of 0.01 to 15 % by weight. In the above patent publication (Japanese Patent Laid-Open No. 231552/1984) describing the compound with a hydrophobic index of 30 to 80, it is proposed to add hydrophobic silica in an amount of 0.01 to 20% by weight.

However, there remained the problems that, if the addition amount of silica is increased, the isolated silica gives damage to the surface of a photoconductor drum and the silica causes black spots as the initiator. The black spot is a type of filming on a photoconductor drum and it appears as black points on a visible image. Because the particles of hydrophobic silica are considerably hard, this phenomenon is remarkably appeared when the photoconductor drum used is a substance of relatively low hardness such as a selenium-tellurium type or an organic photoconductor drum. Further, the same problem occurs even in case of a selenium-arsenic type substance, which is relatively hard but is brittle to mechanical shock.

Accordingly, it is preferred that the addition amount of silica be as low as possible, and it is also preferred to use such hydrophobic silica, which can improve electric charge retainability and fluidity of the toner by adding it in such very small quantity.

On the other hand, a hydrophobic treatment of silica has been performed in the past through the volatile silanes in a reactor heated at about 400° C. For example, a method to utilize the thermal decomposition oxidizing reaction in oxyhydrogen flame of silicon tetrachloride gas has been used, wherein the following reaction occurs:

$$SiCl_4+2H_2+O_2 \rightarrow SiO_2+4HCl$$

In the meantime, because it is not very easy to remove hydrogenchloride generated during the reaction, it has been pointed out that the pH value of the hydrophobic silica thus obtained decreases to about 3 to 2, and the problems such as the rusting on inner wall of the tank for hydrophobic silica in the toner facilities during long-term use arise.

Specifically, the conventional hydrophobic silica obtained in the past had the various problems such as the suitability of the degree of hydrophobic property and the amount to be added, and in addition to these problems the counter measures are urgently needed to improve the acidification of hydrophobic silica fine powder caused by a hydrogen chloride generated during the treatment.

SUMMARY OF THE INVENTION

The present invention has been made just to solve the above mentioned problems and an object of the present invention is to provide a toner composition using a particular polyester resin as a binder resin, which is characterized in that electric charge retainability and fluidity of the toner are not decreased, a visible image with good quality is stably formed and a number of visible images are obtained for a long period with no black spots occurring.

The present inventors have been studying the methods to solve the above mentioned problems and have found that, if hydrophobic silica fine powder treated to have the degree of hydrophobic property of 80 or more is used, electric charge retainability and fluidity of a toner are not decreased and an excellent visible image can be formed. And the further studies led to the present invention.

Specifically, the gist of the present invention relates to a toner composition containing a polyester resin having an OHV/AV value of 1.2 or more as a major component of a binder resin wherein AV is an acid value of said polyester and OHV is a hydroxyl value thereof, and 0.01 to 1.5 parts by weight of hydrophobic silica having a degree of hydrophobic property of 80 or more to 100 parts by weight of said toner wherein said degree is determined by a methanol titration test. Also, the invention relates to a toner composition containing a polyester resin having an OHV/AV value of 1.2 or more as a major component of a binder resin, and 0.01 to 1.5 parts by weight of hydrophobic silica having a pH value of 5.5 to 8 to 100 parts by weight of said toner when 4% by weight of said hydrophobic silica is dispersed in water-methanol solution (1:1).

DETAILED DESCRIPTION OF THE INVENTION

A binder resin for a toner composition of the present invention contains a polyester resin as a major component, and there is no special restriction to it as far as it is a polyester resin. It is preferred, however, that the polyester resin has an OHV/AV value of 1.2 or more wherein AV is an acid value thereof and OHV is a hydroxyl value thereof.

Such a resin can be obtained by the condensation polymerization of alcohol and carboxylic acid, carboxylate ester or carboxylic acid anhydride. As an alcohol components, there are:

(a) a diol component represented by the general formula (I):

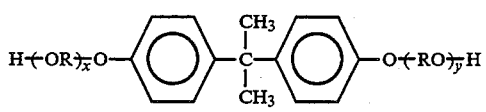

(I)

(wherein R represents an ethylene or propylene group, x and y each are an integer of 1 or more, and the average value of x+y is 2 to 7.)

Examples of the diol component include polyoxypropylene (2.2)-2,2-bis(4-hydroxyphenyl)propane, polyoxypropylene (3.3)-2,2-bis(4-hydroxyphenyl)propane, polyoxyethylene(2.0)-2,2-bis (4-hydroxyphenyl)propane, polyoxypropylene(2.0)-polyoxyethylene (2.0)-2,2-bis(4-hydroxyphenyl)propane, polyoxypropylene(6)-2,2-bis(4-hydroxyphenhyl)propane and the like.

When appropriate, the other diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol, or other dihydric alcohols such as bisphenol A and hydrogenated bisphenol A may be further added.

(b) The following substances may be used as carboxylic acid, carboxylate ester or carboxylic acid anhydride:

Examples of dihydric substances include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid and the like, with preference given to maleic acid, fumaric acid, phthalic acid, isophthalic acid, terephthalic acid and succinic acid. Further, there are an alkylsuccinic acid or a alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid and tetrapropenylsuccinic acid. Or, an anhydride thereof, a lower alkyl ester thereof and other dihydric carboxylic acids may be used.

Next, as the trihydric or higher substances among functional monomers of trihydric or higher, examples of the alcohol component include sorbitol, 1,2,3,6-hexanetetrol, 1,4-sorbitan, pentaerythritol, dipentaerythritol, tripentaertythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzene and other trihydric or higher alochols, with preference given to pentaerythritol, trimethylolethane and trimethylolpropane. Examples of a trihydric or higher carboxylic acid component include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, an anhydride thereof, a lower alkyl ester thereof and other trihydric or higher carboxylic acids, with preference given to 1,2,4-benzenetricarboxylic acid, the anhydride thereof and a lower alkyl ester thereof.

As the polyhydric carboxylic acids, a tetracarboxylic acid represented by the following formula can be used:

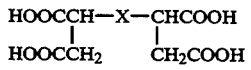

(wherein X represents an alkylene or alkenylene group having a carbon number of 5 to 30, containing one or more side chains, each of these having a carbon number of 3 or more)

More concretely, the substances in the following (1) to (12) are included:

(1) 4-neopentylidenyl-1,2,6,7-heptanetetracarboxylic acid
(2) 4-neopentyl-1,2,6,7-heptene(4)-tetracarboxylic acid
(3) 3-methyl-4-heptenyl-1,2,5,6,-hexanetetracarboxylic acid
(4) 3-methyl-3-heptyl-5-methyl-1,2,6,7-heptene(4)-tetracarboxylic acid
(5) 3-nonyl-4-methylidenyl-1,2,5,6-hexanetetracarboxylic acid
(6) 3-decylidenyl-1,2,5,6-hexanetetracarboxylic acid
(7) 3-nonyl-1,2,6,7-heptene(4)-tetracarboxylic acid
(8) 3-decenyl-1,2,5,6-hexanetetracarboxylic acid
(9) 3-butyl-3-ethylenyl-1,2,5,6-hexanetetracarboxylic acid
(10) 3-methyl-4-butylidenyl-1,2,6,7-heptanetetracarboxylic acid
(11) 3-methyl-4-butyl-1,2,6,7-heptene(4)-tetracarboxylic acid
(12) 3-methyl-5-octyl-1,2,6,7-heptene(4)-tetracarboxylic acid A polyester resin in the present invention can be prepared by co-condensation polymerization of a diol component as shown in (a) above and a carboxylic acid, carboxylate ester or carboxylic acid anhydride shown in (b) above. For example, it can be prepared by condensation polymerization at a temperature of 180° to 250° C. in an inert gas atmosphere. In this preparation, an esterification catalyst commonly used such as zinc oxide, stannous oxide, dibutyltin oxide and dibutyltin dilaurate may be used to accelerate the reaction. Alternatively, it may also be prepared under a reduced pressure for the same purpose.

A polyester resin prepared in this procedure includes the following:

i) Polyester resin (i)

A polyester resin containing ethyl acetate insolubles in an amount of 3.0 % by weight or more (Japanese Patent Laid-Open No. 195676/1987)

ii) Polyester resin (ii)

A polyester resin prepared by co-condensation polymerization of:

(1) a diol component in (a) above;
(2) a dihydric carboxylic acid, an anhydride thereof or a lower alkyl ester thereof in (b) above;
(3) a trihydric or higher carboxylic acid, an anhydride thereof or a lower alkyl ester thereof in (b) above, or a trihydric or higher polyhydric alcohol (Japanese Patent Laid-Open No. 195677/1987)

iii) Polyester resin (iii)

A polyester resin prepared by co-condensation polymerization of:

(1) a diol component in (a) above;
(2) Among dihydric carboxylic acids in (b) above, a dihydric carboxylic acid containing an alkyl or alkenyl succinic acid in an amount of 5 to 50 mol % in total carboxylic acid components, an anhydride thereof or a lower alkyl ester thereof;
(3) a trihydric or higher polyhydric carboxylic acid, an acid anhydride thereof or a lower alkyl ester thereof in (b) above, or a trihydric or higher polyhydric alcohol (Japanese Patent Laid-Open No. 195678/1987)

iv) Polyester resin (iv)

A polyester resin prepared by co-condensation polymerization of:

(1) a diol component in (a) above;
(2) Among dihydric carboxylic acids in (b) above, a dihydric carboxylic acid containing an alkyl or alkenyl succinic acid in an amount of 5 to 50 mol % in total carboxylic acid components, an acid anhydride thereof or a lower alkyl ester thereof;
(3) a trihdyric or higher polyhydric carboxylic acid containing tetracarboxylic acid represented by the following formula in (b) above:

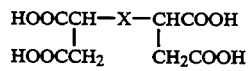

(wherein X represents an alkylene or alkenylene group having a carbon number of 5 to 30, containing one or more side chains, each of these having a carbon number of 3 or more), an acid anhydride thereof or a lower alkyl ester thereof in an amount of 0.1 to 20 mol % in total carboxylic acid components, an acid anhdyride thereof or a lower alkyl ester thereof. (Japanese Patent Laid-Open No. 195679/1987)

v) Polyester resin (v)

A polyester resin prepared by co-condensation polymerization of:

(1) a diol component in (a) above;

(2) a dihydric carboxylic acid, an acid anhydride thereof or a lower alkyl ester thereof in (b) above;

(3) a trihydric or higher polyhydric alcohol in (b) above;

(4) a trihydric or higher polyhydric carboxylic acid, an acid anhydride thereof or a lower alkyl ester thereof in (b) above (Japanese Patent Laid-Open No. 195680/1987)

As the polyester resin in the present invention, the polyester resins (i) to (v) having an OHV/AV value of 1.2 or more are used, and the AV and the OHV can be determined according to the method as stipulated in JIS K 0070. In this case, when the content of ethyl acetate insolubles exceeds 3.0% by weight, it is preferred to use dioxane as a solvent for the determination of an acid value.

The polyester having an OHV/AV value of 1.2 or more can be easily prepared by co-condensation polymerisation in which a total amount of the alcohol components is more than that of the carboxylic acid components in terms of the number of the functional groups (See Japanese Patent Laid-Open Nos. 195677/1987, 195678/1987, 68849/1988, 68850/1988, 163469/1988 and 155362/1989, etc.).

The polyester resin in the present invention is used as a major component of a binder resin. The binder resin may further contain other resins such as a styrene or styrene-acrylate resin having a number-average molecular weight of 11,000 or below in an amount not exceeding 30% by weight in the binder resin to enhance the pulverizability for producing a toner. In preparing a toner, a releasing agent such as wax is added as offset inhibitors. When the polyester resin according to the present invention is used as a binder resin, there is no need to add the above releasing agent, or even if they are added, the amount thereof may be smaller.

The hydrophobic silica used in the present invention is obtained by a treatment with an organic silicon compound having an organic group such as a trialkyl group. More concretely, it can be obtained by a treatment with hexamethyldisilazane, trimethylchlorosilane or polydimethylsiloxane, and the degree of the hydrophobic property determined by the methanol titration test is 80 or more. For example, the substance having a degree of hydrophobic property of about 80 to 110 is used.

Here, a degree of hydrophobic property is the value obtained as follows:

In a beaker having a volume of 200 ml, 50 ml of pure water is placed and 0.2 g of silica is added. While strirring with a magnetic stirrer so gently that water surface is not recessed, methanol is dropped from a burette, the tip of which is immersed in water. The amount of the dropped methanol (in ml) until the floating silica begins to sink is regarded as the degree of hydrophobic property. In this case, methanol has surface active effect, and the floating silica is dispersed into water (i.e. it begins to sink) through methanol when methanol is dropped. Therefore, the higher degree of hydrophobic property (i.e. the more amount of methanol is dropped) means the more hydrophobic property of the silica.

As an organic silicon compound used in this treatment to increase hydrophobic property, an organic silicon compound having a trialkylsilyl group are normally used. Examples of the compound include hexamethyldisilazane, trimethylsilane, trimethylchlorosilane, trimethylethoxysilane, triorganosilylmercaptan, trimethylsilylmercaptan, triorganosilylacrylate, hexamethyldisiloxane and polydimethylsiloxane which has 2 to 12 siloxane units per molecule and contains hydroxyl group bonded with Si each at the unit located on the terminal end, with preference given to haxamethyldisilazane, trimethylchlorosilane and polydimethylsiloxane. Other silicon compounds such as vinyldimethylacetoxysilane, dimethylethoxysilane, dimethyldimethoxysilane, 1,3-divinyltetramethyldisiloxane and 1,3-diphenyltetramethyldisiloxane may also be used. These substances are used alone or as a mixture of two or more substances.

The hydrophobic silica in the present invention has a pH value of 5.5 to 8 when 4% by weight of hydrophobic silica is dispersed in water-methanol solution (1:1). This is because the hydrophobic silica in the present invention has a higher degree of hydrophobic property in the entire surface. In the conventional type hydrophobic silica treated with a silicon halogen compound such as dimethylchlorosilane, methyltrichlorosilane and trimethylchlorosilane, hydrogen chloride is generated during the reaction and it remained by about 0.05% without being completely removed. Thus, it has a low pH value. However, in case of hydrophobic silica treated with hexamethyldisilazane, trimethylchlorosilane or polydimethylsiloxane in the present invention, hydrogen chloride is not generated and the above problem does not occur. While treating with hexamethyldisilazane, ammonia is generated in the reaction and the hydrophobic silica thus obtained shows a higher pH value due to alkalinity of ammonia itself.

The hydrophobic silica having such property can be easily produced by those skilled in the art by means of the above method. As the commercially available product, H-2000 by Wacker Chemicals East Asia Limited (degree of hydrophobic property 80; pH 7), TS-720 by Cabot Corporation (degree of hydrophobic property 80; pH 5.8) and TS-530 by Cabot Corporation (degree of hydrophobic property 110; pH 6.0) can be used.

The conventional type hydrophobic silica as described in the above, for example R-972 manufactured by Nippon Aerosil Co., Ltd. which is a dimethyl substitution product is assumed to have the following structure on the surface.

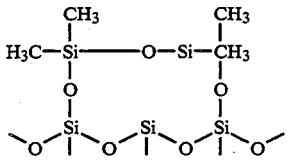

(toner side)
(R-972)

In contrast to this, H-2000 seems to have the structure as shown below. H-2000 has been manufactured to reduce the remaining quantity of a silanol group on the surface of a silicon compound to about 5% or below by promoting the reaction of hexamethyldisilazane to be used for increasing the hydrophobic property.

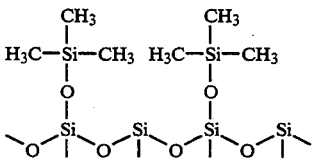

(toner side)
(H-2000)

TS-720 is obtained by a treatment with polydimethylsiloxane and it seems to have the following structure.

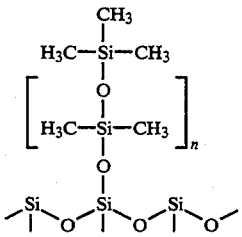

(TS-720)

TS-530 seems to have the following structure, which is obtained by a treatment with hexamethyldisilazane.

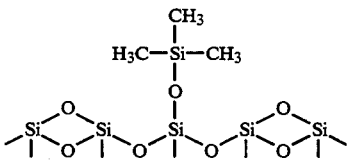

(TS-530)

It is preferred that hydrophobic silica fine power as described above has an average particle size of 0.003 μm to 2 μm, more preferably 0.005 μm to 0.5 82 m. A specific surface area determined by BET method is preferably 20 to 500 $m^2/g$. When an average particle size exceeds 2 μm or when a specific surface area is below 20 $m^2/g$, the surface of the photoconductor drum may tend to be damaged. When an average particle size is below 0.003 μm or when a specific surface area exceeds 500 $m^2/g$, it is difficult to handle because it floats dustily.

It is necessary to add hydrophobic silica in such an amount that electric charge and fluidity of the toner are not decreased even under high temperature and high humidity conditions and that black spots do not occur. The addition amount is normally 0.01 to 1.5 parts by weight to 100 parts by weight of the toner, preferably 0.1 to 1.0 parts by weight.

Specifically, there is no generally definite amount of hydrophobic silica to be added because the adequate addition amount depends upon the particle size of the toner. In general, when a toner particle size is about 12 to 15 μm, it may be added in as small quantity as 0.01 parts by weight. The addition amount is normally 0.01 to 1.0 parts by weight, preferably 0.1 to 0.5 parts by weight. In this case, if the addition amount is below 0.01 parts by weight, the effective results can not be obtained. If it exceeds 1.0 parts by weight, it is not preferred because black spots may occur.

In the case that a toner particle size is below 12 μm, the addition amount of hydrophobic silica is normally 0.1 to 1.5 parts by weight, preferably 0.2 to 1.0 parts by weight. In this case, if the addition amount is below 0.1 parts by weight, sufficient fluidity can not be attained. If it exceeds 1.5 parts by weight, it is not preferred because black spots may occur as described above.

As the colorants to be used for a toner composition of the present invention, carbon black, iron black and the like as conventionally known can be used.

To a toner composition of the present invention, a charge control agent is added if necessary. To the negative charge toner, one or more types selected from all negative charge control agents, which are known to be used for an electrophotography in the past, may be used. Examples of the negative charge control agents include metal-containing azo dyes such as "Varifast Black 3804", "Bontron S-31", "Bontron S-32", "Bontron S-34"and "Bontron S-36" (all these products are manufactured by Orient Chemical Co., Ltd.) and "Aizen Spilon Black TVH" (manufactured by Hodogaya Chemical Co., Ltd.); copper phthalocyanine dyes; metal complexes of alkyl derivatives of salicylic acid such as "Bontron E-85" (manufactured by Orient Chemical Co., Ltd.) and the like.

It is also possible to simultaneously use with the positive charge control agent. When the positive charge control agent is used in an amount of one-half or below of the amount of the negative charge control agent, good visible images can be obtained with no reduction in image density even after 50,000 copies.

To the positive charge toner, one or more types selected from all positive charge control agents, which are known to be used for an electrophotography in the past, may be used. Examples of the positive charge control agent include nigrosine dyes such as "Nigrosine Base EX", "Oil Black BS", "Oil Black SO", "Bontron N-01" and "Bontron N-11" (all these products are manufactured by Orient Chemical Co., Ltd.); triphenylmethane dyes having a tertiary amine as a side chain; quaternary ammonium salt compounds such as "Bontron P-51" (manufactured by Orient Chemical Co., Ltd.) and cetyltrimethylammonium bromide; polyamine resin such as "AFP-B" (manufactured by Orient Chemical Co., Ltd.) and the like.

The above charge control agent may be contained in the composition in an amount of 0.1 to 8.0% by weight, preferably 0.2 to 5.0% by weight, based on the binder resin.

To use a toner of the present invention as a magnetic toner, a magnetic powder may be added. As a magnetic powder for such purpose, a substance magnetized in a magnetic field is used. Examples of such substances include the powder of ferromagnetic metals such as iron, cobalt and nickel, alloys or compounds such as magnetite, hematite and ferrite. The preferable content of such magnetic powder is 15 to 70% by weight to the toner weight.

Further, a toner according to the present invention is used as a developer for an electric latent image, if necessary, by mixing it with carrier particles such as iron powder, glass beads, nickel powder and ferrite powder.

A toner composition of the present invention can be applied to various developing methods. Examples of the methods include the magnetic brush development, the cascade development, the development using a conductive magnetic toner, the development using an insulative magnetic toner, the fur brush development, the powder cloud development, the impression development and the like.

A toner composition of the present invention thus obtained contains hydrophobic silica having a degree of hydrophobic property of 80 or more. Accordingly, electric charge and fluidity of toner particles are not decreased under high temperature and high humidity conditions even though a polyester resin has a little more hydrophilic property than stylene acrylate resin and is used as a major component of the binder resin. Because it is added in a very slight quantity, the occurrence of black spots can be prevented.

Also, because a pH value of hydrophobic silica used in the present invention is 5.5 to 8, rusting does not occur on the inner wall of the tank for hydrophobic silica in the toner facilities even in long-term use.

In addition, even when a toner using such silica for a surface treatment is mixed with carriers such as iron powder or ferrite and it is preserved as a developer for a long time, rusting does not occur easily on the surface of the carrier.

EXAMPLES

The present invention is hereinafter described in more detail by means of the following examples and comparative examples, but the invention is not limited to these examples.

In the Examples, all parts are expressed by weight.

Resin Manufacture Example 1

714 g of polyoxypropylene (2.2)-2,2-bis-(4-hydroxyphenyl) propane, 663 g of polyoxyethylene (2.2)-2,2-bis(4-hydroxyphenyl) propane, 518 g of isophthalic acid, 70 g of isooctenylsuccinic acid, 80g of 1,2,4-benzenetricarboxylic acid, and 2 g of dibutyltin oxide were placed in a 3-l four-necked glass flask equipped with a thermometer, a stainless steel stirring rod, a reflux condenser and a nitrogen-inlet tube and heated up to 210° C. in a mantle heater in a nitrogen atmosphere under stirring to carry out the reaction. The degree of polymerization was monitored from a softening point according to ASTM E 28-51T and the reaction was terminated when the softening point had reached 130° C. The resin thus obtained was a solid substance in light yellow color and a glass transition temperature determined by the DSC (differential scanning calorimeter) was 65 ° C. The acid value of the resin was 18 KOH mg/g, while the hydroxyl value thereof was 35 KOH mg/g. Hereinafter, the resin is referred as "binder resin (1)" (OHV/AV=1.94).

Resin Manufacture Example 2

By the same procedure as in the above Resin Manufacture Example 1, except that the amount of isophthalic acid was changed to 710 g, a polyester resin was obtained, which has a softening point of 130° C., a glass transition temperature of 69° C., an acid value of 30 KOH mg/g and a hydroxyl value of 19 KOH mg/g. Hereinafter, this resin is referred as "binder resin" (2)" (OHV/AV=0.63).

Preparation of Toner

After the materials having the composition as shown below were mixed well by Henschel mixer, the mixture was kneaded by a twin screw compounder and was cooled and coarsely crushed. Then, it was pulverized by a jet mill and was further classified by a pneumatic classifier to obtain fine powder having an average particle size of 10 μm.

| | |
|---|---|
| Toner X: | |
| binder resin (1) | 88 parts |
| carbon black "Regal 400R" (manufactured by Cabot Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |
| Toner Y: | |
| binder resin (1) | 90 parts |
| carbon black "Carbon black #44 (manufactured by Mitsubishi Kasei Corporation) | 5 parts |
| negative charge control agent "Bontron S-34" (manufactured by Orient Chemical Co., Ltd.) | 2 parts |
| positive charge control agent "Bontron N-01" (manufactured by Orient Chemical Co., Ltd.) | 1 parts |
| wax "Viscol 550P" (manufactured by Sanyo Chemical Industries, Ltd.) | 2 parts |
| Toner Z: | |
| binder resin (2) | 88 parts |
| carbon black "Regal 400R" (manufactured by Cabot Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |

Example 1

To 1,000 g of the above toner X, 1.5 g of hydrophobic silica "HDK H-2000" (manufactured by Wacker Chemicals East Asia Limited) was added. The toner 1 was obtained by mixing it by a Henschel mixer.

Example 2

To 1,000 g of the above toner X, 2.5 g of hydrophobic silica "HDK H-2000" was added. The toner 2 was obtained by mixing it by a Henschel mixer.

Example 3

To 1,000 g of the above toner X, 3.5 g of hydrophobic silica "HDK H-2000" was added. The toner 3 was obtained by mixing it by a Henschel mixer.

Example 4

To 1,000 g of the above toner X, 5.0 g of hydrophobic silica "HDK H-2000" was added. The toner 3 was obtained by mixing it by a Henschel mixer.

Example 5

To 1,000 g of the above toner Y, 1.5 g of hydrophobic silica "CAB-O-SIL TS-720" (manufactured by Cabot Corporation) was added. The toner 5 was obtained by mixing it by a Henschel mixer.

Example 6

To 1,000 g of the above toner Y, 2.5 g of hydrophobic silica "CAB-O-SIL TS-720" was added. The toner 6 was obtained by mixing it by a Henschel mixer.

Example 7

To 1,000 g of the above toner Y, 1.5 g of hydrophobic silica "CAB-O-SIL TS-530" (manufactured by Cabot Corporation) was added. The toner 7 was obtained by mixing it by a Henschel mixer.

Example 8

To 1,000 g of the above toner Y, 2.5 g of hydrophobic silica "CAB-O-SIL TS-530" was added. The toner 8 was obtained by mixing it by a Henschel mixer.

Comparative Example 1

To 1,000 g of the above toner X, 2.5 g of hydrophobic silica "AEROSIL R-972" (manufactured by Nippon Aerosil Co., Ltd.) was added. The comparative toner 1 was obtained by mixing it by a Henschel mixer.

Comparative Example 2

To 1,000 g of the above toner X, 5.0 g of hydrophobic silica "AEROSIL R-972" was added. The comparative toner 2 was obtained by mixing it by a Henschel mixer.

Comparative Example 3

To 1,000 g of the above toner X, 2.5 g of hydrophobic silica "AEROSIL R-976" (manufactured by Nippon Aerosil Co., Ltd.) was added. The comparative toner 3 was obtained by mixing it by a Henschel mixer.

Comparative Example 4

To 1,000 g of the above toner Z, 1.5 g of hydrophobic silica "HDK H-2000" was added. The comparative toner 4 was obtained by mixing it by a Henschel mixer.

Comparative Example 5

To 1,000 g of the above toner Z, 5.0 g of hydrophobic silica "HDK H-2000" was added. The comparative toner 5 was obtained by mixing it by a Henschel mixer.

Using the above toners, the fluidity and the electric charge-to-mass ratio as well as the occurrence of black spots were evaluated.

The fluidity of the toner was determined by a toner fluid tester as described below. Specifically, it is a fluidity evaluation apparatus equipped with a screw rotating at a speed of 10 rpm in a conical hopper and a buffer unit. For the measurement, 300 g of the toner to be measured is placed in a 1-l polyvinyl container. After shaking it strongly up and down by hand for 10 times, the content is transferred to a hopper. By rotating a motor for 5 minutes, the fallen amount of the toner per minute is determined from the weight of the toner fallen onto the receptacle, and this is regarded as the fallen amount of the toner [g/min].

The charge-to-mass ratio was measured by a blow-off tribo electric charge measuring apparatus as described below. Specifically, it is a charge-to-mass ratio measuring apparatus equipped with a Faraday gauge, a capacitor and an electrometer. For the measurement, the toner sample to be measured is mixed well with a spherical ferrite carrier having a particle size of 250 to 200 mesh by the weight ratio of 10:90, followed by stirring and the developer is thus prepared.

W (g) (0.15 to 0.20 g) of the developer thus prepared is placed into a brass measurement cell equipped with a stainless steel screen of 500 mesh (adjustable to any mesh size to block the passing of carrier particles). Then, after sucking this for 5 seconds from the suction hole, it is blown off for 5 seconds at an air pressure of 0.6 kg/m$^2$ as indicated by an air pressure regulator and only the toner is removed from the cell. It is supposed that the voltage on the electrometer at 2 seconds after starting the blowing is V (volt). If it is supposed that an electric capacity of the capacitor is C ($\mu$F), a charge-to-mass ratio Q/m of this toner is given by the following equation:

$$Q/m(\mu c/g) = \frac{C \times V}{m}$$

Here, m represents a weight of the toner contained in W (g) of a developer. In the case that a toner weight in a developer is supposed to be T (g), and a weight of a developer is D (g), a consentration of a specimen toner is expressed by: T/D×100 (%), and m is obtained from the following equation.

$$m(g) = W \times \frac{T/D}{100}$$

As a developer, a spherical ferrite carrier having a particle size of 250 to 200 mesh was mixed with the toner in the ratio of 90 parts by weight to 10 parts by weight of the toner. This was used on a copier which was equipped with a selenium photoconductor drum and 50,000 copies were continuously taken under normal environmental conditions (23° C.; 50% RH) or under high temperature and high humidity conditions (35° C.; 85% RH). The variations of an electric charge during the printing durability test and the occurrence of black spots were compared. The results are shown in Table 1. Compared with the toners 1 to 8, the electric charge extensively decreased in the comparative toners 1, 2 and 3 after 50,000 copies were taken under high temperature and high humidity conditions. In all cases of the comparative toners, black spots were occurred under high temperature and high humidity conditions. The comparative toners 4 and 5 exhibited the poor fluidity compared with the toners 1 to 8, and the electric charge extensively increased after 50,000 copies were taken under both normal environmental conditions and high temperature and high humidity conditions. As the result, the image density decreased and white spots due to carrier sticking appeared when a black solid original was copied.

TABLE 1(1)

| Toner | Hydrophobic silica kind | Hydrophobic silica addition amount | OHV/AV of binder resin | Fluidity of toner [g/min] | Electric charge of toner [$\mu$c/g] | Change of electric charge after 50,000 copies under normal conditions, 23° C., 50% RH(NN) [$\mu$c/g] | Change of electric charge after 50,000 copies under high temperature and high humidity conditions 35° C., 85% RH(HH) [$\mu$c/g] | Number of copies duplicated until black spots occur NN | Number of copies duplicated until black spots occur HH |
|---|---|---|---|---|---|---|---|---|---|
| Toner | | | | | | | | | |
| 1 | H-2000 | 0.15% | 1.94 | 7.0 | −19.2 | −1 | −3 | no occurrence | no occurrence |
| 2 | H-2000 | 0.25% | 1.94 | 7.8 | −20.1 | +1 | −1 | no occurrence | no occurrence |
| 3 | H-2000 | 0.35% | 1.94 | 8.5 | −24.4 | +2 | +1 | no | no |

TABLE 1(1)-continued

| Toner | Hydrophobic silica kind | Hydrophobic silica addition amount | OHV/AV of binder resin | Fluidity of toner [g/min] | Electric charge of toner [μc/g] | Change of electric charge after 50,000 copies under normal conditions, 23° C., 50% RH(NN) [μc/g] | Change of electric charge after 50,000 copies under high temperature and high humidity conditions 35° C., 85% RH(HH) [μc/g] | Number of copies duplicated until black spots occur NN | Number of copies duplicated until black spots occur HH |
|---|---|---|---|---|---|---|---|---|---|
| | | | | | | | | occurrence | occurrence |
| 4 | H-2000 | 0.50% | 1.94 | 9.2 | −26.1 | +3 | +2 | no occurrence | no occurrence |
| 5 | TS-720 | 0.15% | 1.94 | 6.9 | −20.0 | −2 | −3 | no occurrence | no occurrence |
| 6 | TS-720 | 0.25% | 1.94 | 7.4 | −22.3 | +1 | −2 | no occurrence | no occurrence |
| 7 | TS-530 | 0.15% | 1.94 | 7.3 | −18.5 | −1 | +1 | no occurrence | no occurrence |
| 8 | TS-530 | 0.25% | 1.94 | 8.2 | −20.7 | +1 | +3 | no occurrence | no occurrence |
| Comparative Toner | | | | | | | | | |
| 1 | R-972 | 0.25% | 1.94 | 6.7 | −18.1 | +2 | −9 | no occurrence | occurred at 35,000 copies |
| 2 | R-972 | 0.50% | 1.94 | 7.9 | −21.2 | +5 | −4 | occurred at 20,000 copies | occurred at 10,000 copies |
| 3 | R-976 | 0.25% | 1.94 | 7.0 | −19.8 | +4 | −5 | no occurrence | occurred at 50,000 copies |
| 4 | H-2000 | 0.15% | 0.63 | 5.1 | −26.7 | +3 | +9 | no occurrence | no occurrence |
| 5 | H-2000 | 0.50% | 0.63 | 6.9 | −28.7 | +6 | +14 | no occurrence | no occurrence |

Degree of hydrophobic property of H-2000 80, pH 7.0
Degree of hydrophobic property of TS-720 80, pH 5.8
Degree of hydrophobic property of TS-530 110, pH 6.0
Degree of hydrophobic property of R-972 40, pH 4.0
Degree of hydrophobic property of R-976 40, pH 4.0

As it is evident from these results, when hydrophobic silica in the present invention is added to the toner containing a polyester resin having an OHV/AV value of 1.2 or more, the toner exhibits higher fluidity and higher electric charge in an smaller addition amount than that of the hydrophobic silica with a lower degree of hydrophobic property as used in the past. The electric charge can be more stably maintained even when it is used under high temperature and high humidity conditions. Particularly, in the toner having a particle size of below 12 μm, it has been necessary to increase an addition amount of hydrophobic silica in the past for the purpose of maintaining the fluidity, whereas it has come to be possible to raise the marginal point for the occurrence of black spots because an addition amount of hydrophobic silica in the present invention such as H-2000 may be smaller than that of conventional type hydrophobic silica. These effects have been achieved only by a toner composition of the present invention.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner composition comprising a polyester resin having an OHV/AV value of 1.2 or more as a major component of a binder resin wherein AV is an acid value of said polyester and OHV is a hydroxyl value thereof and hydrophobic silica having a degree of hydrophobic property of not less than 80 said degree being determined by a methanol titration test, and a pH value of 5.5 to 8 when 4% by weight of said hydrophobic silica is dispersed in a water-methanol solution (1:1), said resulting toner composition showing substantially improved charge retention properties under conditions of high temperature and high humidity.

2. A toner composition according to claim 1, wherein said hydrophobic silica is obtained by a treatment with an organic silicon compound having a trialkyl group.

3. A toner composition according to claim 1, wherein said organic silicon compound is selected from at least one member of the group consisting of hexamethyldisilazane, trimethylchlorosilane and polydimethylsiloxane.

4. A toner composition according to claim 1, wherein a chemical structure of said toner composition comprising said hydrophobic silica is selected from at least one of the formulas:

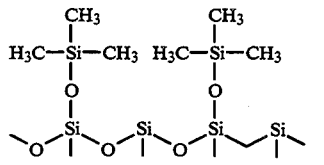

(1)

toner side

-continued (2)

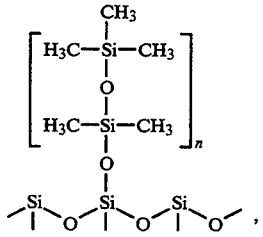

toner side and (3)

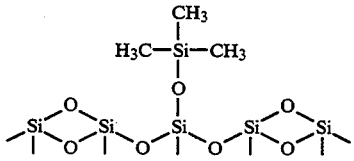

toner side

5. A toner composition according to claim 1 wherein an addition amount of said hydrophobic silica is 0.01 to 1.5 parts by weight to 100 parts by weight of said toner.

6. A toner composition according to claim 5, wherein said hydrophobic silica is contained in an amount of 0.1 to 1.0 parts by weight per 100 parts by weight of said toner.

7. A toner composition according to claim 6, wherein said hydrophobic silica is contained in an amount of 0.1 to 0.5 parts by weight per 100 parts by weight of said toner.

8. A toner composition according to claim 6, wherein said hydrophobic silica is contained in an amount of 0.2 to 1.0 parts by weight per 100 parts by weight of said toner.

9. A toner composition according to claim 1 wherein said polyester resin is prepared by co-condensation polymerization of:

(1) a diol component represented by the formula:

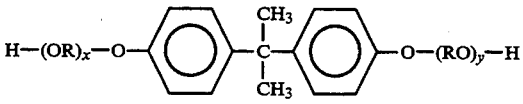

wherein R represents an ethylene or propylene group, x and y each are an integer of 1 or more, and the average value of x+y is 2 to 7;

(2) a dihydric carboxylic acid, an anhydride thereof or a lower alkyl ester thereof; and (3) a trihydric or higher carboxylic acid, an anhydride thereof or a lower alkyl ester thereof; or a trihydric or higher polyhydric alcohol.

10. A toner composition according to claim 9 wherein said diol component is selected from the group consisting of polyoxypropylene (2.2)-2,2-bis(4-hydroxyphenyl)propane, polyoxypropylene (3.3)-2,2-bis(4-hydroxyphenyl)propane, polyoxyethylene(2.0)-2,2-bis(4-hydroxyphenyl)propane, polyoxypropylene(2.0)-polyoxyethylene (2.0)-2,2-bis(4-hydroxyphenyl)propane and polyoxypropylene(6)-2,2-bis(4-hydroxyphenhyl)propane; said dihydric carboxylic acid is selected from the group consisting of maleic acid, fumaric acid, phthalic acid, isophthalic acid, terephthalic acid, succinic acid, n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid and tetrapropenylsuccinic acid; said trihydric or higher polyhydric alcohol is selected from the group consisting of pentaerythritol, trimethylolethane and trimethylolpropane; and said trihydric or higher polyhydric carboxylic acid is 1,2,4-benzenetricarboxylic acid.

11. A toner composition according to claim 1 wherein said polyester resin is prepared by co-condensation polymerization of:

(1) a diol component represented by the formula:

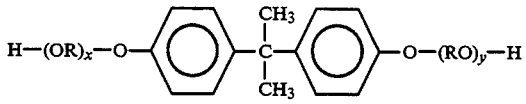

wherein R represents an ethylene or propylene group, x and y each are an integer of 1 or more, and the average value of x+y is 2 to 7;

(2) a dihydric carboxylic acid containing an alkyl or alkenyl succinic acid in an amount of 5 to 50 mol % in total carboxylic acid components, an anhydride thereof or a lower alkyl ester thereof; and (3) a trihydric or higher polyhydric carboxylic acid, an acid anhydride thereof or a lower alkyl ester thereof; or a trihydric or higher polyhydric alcohol.

12. A toner composition according to claim 11 wherein said diol component is selected from the group consisting of polyoxypropylene (2.2)-2,2-bis(4-hydroxyphenyl)propane, polyoxypropylene (3.3)-2,2-bis(4-hydroxyphenyl)propane, polyoxypropylene (2.0)-2,2-bis(4-hydroxyphenyl)propane, polyoxypropylene (2.0)-polyoxyethylene (2.0)-2,2-bis(4-hydroxyphenyl)propane and polyoxypropylene (6)-2,2-bis(4-hydroxyphenyl)propane; said dihydric carboxylic acid is selected from the group consisting of maleic acid, fumaric acid, phthalic acid, isophthalic acid, terephthalic acid, succinic acid, n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid and tetrapropenylsuccinic acid; said trihydric or higher polyhydric alcohol is selected from the group consisting of pentaerythritol, trimethylolethane and trimethylolpropane; and said trihydric or higher polyhydric carboxylic acid is 1,2,4-benzenetricarboxylic acid.

13. A toner composition according to claim 1, wherein said hydrophobic silica has a degree of hydrophobic property of 80 to 110.

* * * * *